United States Patent [19]

Bennett

[11] 4,282,732

[45] Aug. 11, 1981

[54] DUST COVER FOR LOCK

[76] Inventor: Robert A. Bennett, 170 Sturbridge Rd., Easton, Conn. 06425

[21] Appl. No.: 110,186

[22] Filed: Jan. 7, 1980

[51] Int. Cl.[3] ..... E05B 17/18

[52] U.S. Cl. ..... 70/455

[58] Field of Search ..... 70/455, 54, 55, 56; 150/52 K, 52 L; 16/178, 179

[56] References Cited

U.S. PATENT DOCUMENTS

| | | | |
|---|---|---|---|
| 1,982,956 | 12/1934 | Jacobi | 70/455 |
| 2,096,568 | 10/1937 | Snively | 70/455 |
| 3,564,744 | 2/1971 | Shook | 70/455 |

FOREIGN PATENT DOCUMENTS

| | | | |
|---|---|---|---|
| 588032 | 1/1925 | France | 70/455 |

*Primary Examiner*—Robert L. Wolfe

[57] ABSTRACT

A dust cover employs an annular member having front and rear surfaces and a central opening together with a disc having front and rear surfaces. The disc and member are pivotally secured together. The disc is movable into and out of sealing engagement with the opening. An elongated pivot lever is secured at one end to the center of the rear surface of the disc and extends outward at right angles thereto.

5 Claims, 7 Drawing Figures

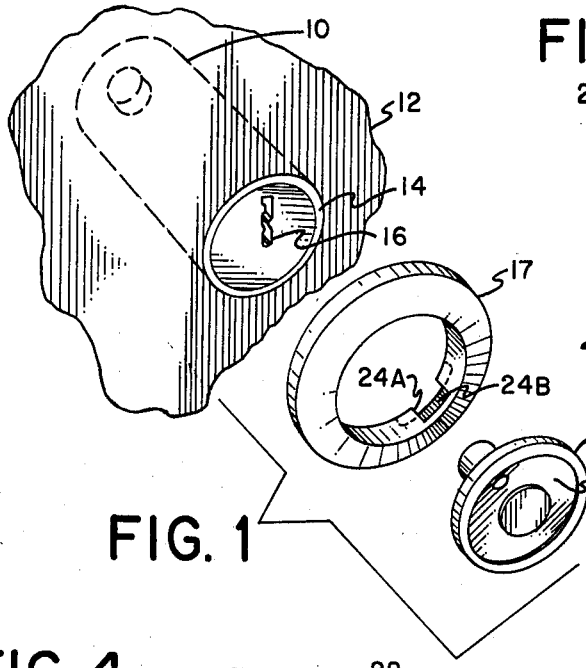
FIG. 1
FIG. 2
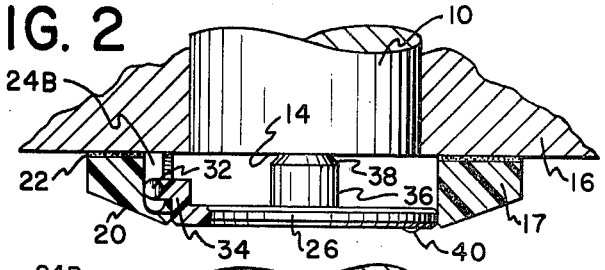
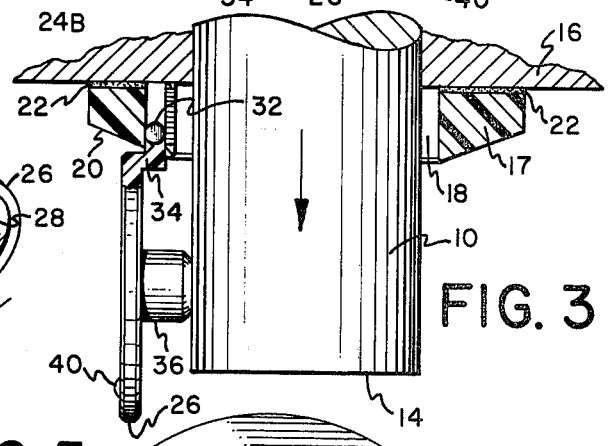
FIG. 3
FIG. 4
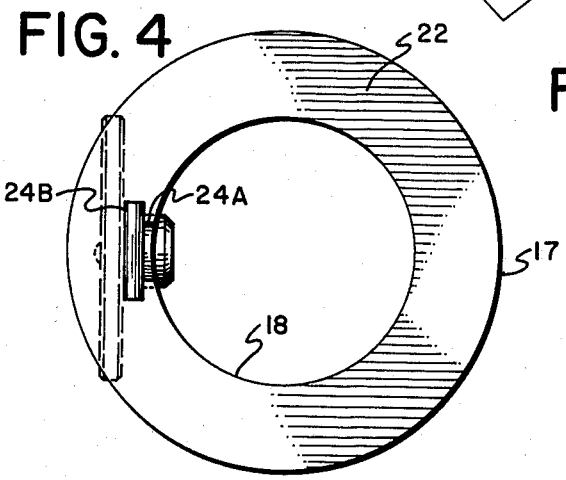
FIG. 5
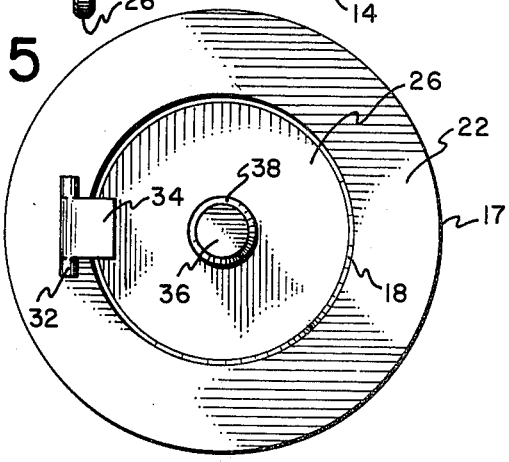
FIG. 6
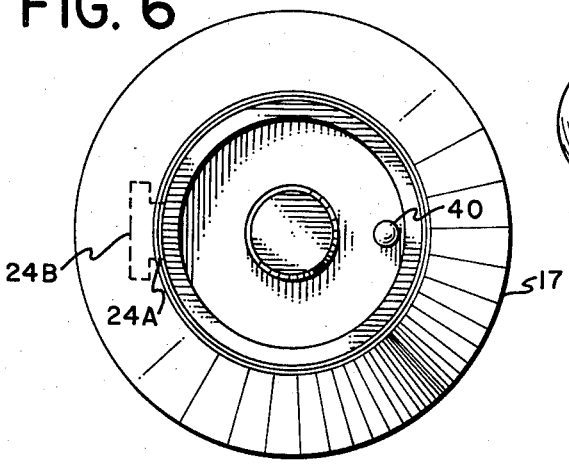
FIG. 7
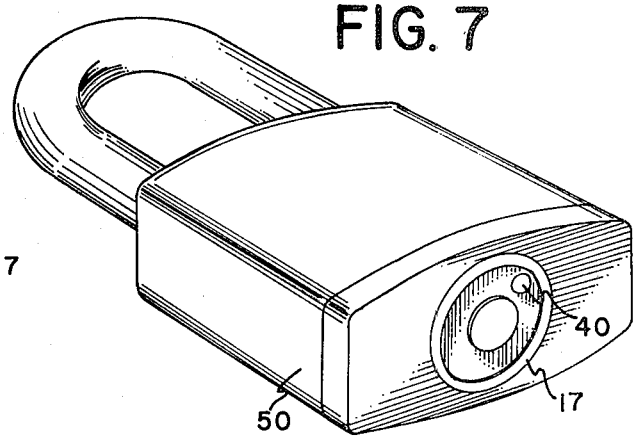

DUST COVER FOR LOCK

BACKGROUND OF THE INVENTION

Trucks and other vehicles employ vertically disposed lock cylinders disposed in a frame with an exposed lower end having a key receiving aperture. When the cylinder is locked, the exposed end is flush with the frame. When the cylinder is unlocked, the cylinder can be pulled downward. When the cylinder is locked, for example, a door of the vehicle is locked in closed position and when the cylinder is unlocked and pulled downward, the door can be unlocked and opened.

However, it is well known to users of such cylinders that over a period of time, dust and other undesired material collects between the frame and the cylinder as well as in the key receiving aperture whereby the cylinder becomes jammed in locked position and cannot be operated manually. Indeed, sometimes the jam cannot be broken even with the use of tools and the cylinder must be removed and replaced.

The present invention is directed toward an inexpensive dust cover which can be easily secured to or removed from such a lock cylinder and which when used with such cylinder will prevent dust and other material from collecting on and around the cylinder whereby the jams caused by collection of such material are eliminated.

SUMMARY OF THE INVENTION

A lock cylinder is disposed within a frame with an exposed end having a key receiving aperture. In accordance with the principles of this invention, an annular member has a central opening centered upon and slightly larger than said exposed end. The member has front and rear surfaces. First means detachably secures the rear surface of the member to said frame.

A disc is adapted to be moved into and out of sealing engagement with said opening.

Second means pivotably interconnects the member to the disc in such manner that the disc and member remain interconnected whether the disc is engaged with or disengaged from the opening.

An elongated pivot lever is secured at one end to the center of the rear surface of the disc and extends at right angles thereto. The other end of the lever is engagable with the one cylinder end when the disc engages the opening.

When the opening is sealed off by the disc, the cylinder is protected from jamming as described.

In order to open the dust cover, manual pressure is applied to the disc periphery causing the disc to pivot about the lever. The disc can then be moved out of engagement with the opening in the annular member providing access to the key aperture and allowing the cylinder to be pulled forward through the opening if desired.

BRIEF DESCRIPTION OF THE DRAWINGS

FIG. 1 is an exploded view of some of the parts used in the invention.

FIG. 2 is a side cross sectional view of the invention in use with a lock cylinder, with the cover closed.

FIG. 3 is a view similar to FIG. 2 but showing the cover open.

FIG. 4 is a rear view of the aperture member with the cover open.

FIG. 5 is a view similar to FIG. 4 with the cover closed.

FIG. 6 is a front view of the invention with the cover closed.

FIG. 7 is a perspective view showing the invention in use with a padlock.

DETAILED DESCRIPTION OF PREFERRED EMBODIMENTS

Referring first to FIGS. 1–3, a lock cylinder 10 disposed in a frame 12 has an exposed end 14 with a key receiving aperture 16 therein. When locked, the cylinder can be slid forward through the frame as shown in FIG. 3.

As shown in FIGS. 1–6, a circular ring shaped or annular member 17 has a central circular opening 18 centered on end 14 and slightly larger in diameter than end 14. The member 17 has a front surface 20 and a flat rear surface. Double faced pressure sensitive adhesive tape 22 secured on one side to the rear surface and on the other side to the frame enables the member 16 to be detachably secured in position.

Member 17 has a slot therein. One portion of this slot shown at 24A extends between the circular opening and a second and enlarged portion 24B. This second portion extends from the rear surface of member 16 toward the front surface but does not reach the front surface.

A flat circular disc 26 is adapted to be moved into sealing engagement with the opening 18 to close the cover or to be moved out of sealing engagement and pivoted out of the path of the lock cylinder. The disc has a front surface 28 which is essentially flush with surface 20 when the cover is closed.

A member has a first portion 32 which fits into the slot portions 24A and 24B, and which lies in a plane parallel to that of the disc and a second portion 34 which extends at right angles to portion 32 and which is integral with a portion of the periphery of disc 26 adjacent the slot portions.

These two portions 32 and 34 enable the disc to be moved back and forth toward and away from the opening and to be pivoted through a sufficient arc to enable the positions of the disc shown in FIGS. 2 and 3 to be obtained.

A pivot lever or cylinder member 36 is secured at one end to the center of the rear surface of the disc and extends outward at right angles thereto to an opposite inwardly tapered end 38. When the cover is closed, end 38 engages end 14 of the lock cylinder.

The front surface of the disc carries a peripherially disposed bump 40 located opposite member portion 34.

When the cover is closed and the user pushes inward on bump 40, the disc pivots about member 36 and member portion 32 moves forward in the slot. This releases the disc and it can be pivoted out of the way as shown in FIG. 3.

FIG. 7 shows the invention in use in a padlock 50 wherein the lock cylinder is held in a frame and cannot be slid back and forth therein.

What is claimed is:

1. In combination with a lock cylinder having one end with a key receiving aperture therein, said cylinder being disposed within a frame, a dust cover comprising:

an annular member having a circular central opening centered on said one cylinder end, the diameter of said opening being slightly larger than the diameter of said cylinder, said member having front and rear surfaces, said member having a slot therein which extends from the rear surface of the member to a position intermediate the front and rear surfaces of the member, said slot communicating with said opening;

first means detachably securing the rear surface of said member to said frame;

a circular disc having front and rear surfaces and adapted to be moved into and out of sealing engagement with said opening, the front surface of the disc being adjacent the front surface of the member when the disc engages the opening;

second means pivotally interconnecting a portion of said member to a portion of the periphery of said disc, one end of said second means being disposed in said slot to enable said one end of the second means to be rotatable in said slot and movable back and forth in said slot toward and away from the rear surface of said member; and an elongated pivot lever secured at one end to the center of the rear surface of said disc and extending at right angles thereto, the other end of said lever being engagable with said one cylinder end when the disc engages the opening.

2. The combination as set forth in claim 1 wherein said one end of said second means and said disc lie in parallel planes.

3. A dust cover device comprising:

an annular member having front and rear surfaces and a central opening, said member having a slot therein which extends from the rear surface thereof to a position intermediate the front and rear surfaces thereof;

a disc having front and rear surfaces and adapted to be moved into and out of sealing engagement with said opening, the front surface of the disc being adjacent the front surface of the member when the disc engages the opening;

means pivotally interconnecting a portion of said member to a portion of the periphery of said disc, one end of said means being disposed in said slot and movable back and forth therein toward and away from the rear surface of the member, whereby said disc can be moved forward out of engagement with said opening and then pivoted to one side of the opening; and an elongated pivot lever secured at one end to the center of the rear surface of said disc and extending at right angles thereto, the other end of said lever being engageable with said one cylinder end when the disc engages the opening.

4. The device of claim 3 wherein the other end of said means is secured to a peripheral portion of said disc adjacent said slot.

5. The device of claim 4 including additional means for detachably securing the rear surface of said member to a supporting frame.

* * * * *